US010132269B2

(12) United States Patent
Magro

(10) Patent No.: US 10,132,269 B2
(45) Date of Patent: Nov. 20, 2018

(54) LIGHTWEIGHT INTERNAL COMBUSTION ENGINE WITH A FERROUS REINFORCED CYLINDER BLOCK

(71) Applicant: GM GLOBAL TECHNOLOGY OPERATIONS LLC, Detroit, MI (US)

(72) Inventor: Lorenzo Magro, Turin (IT)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 146 days.

(21) Appl. No.: 15/134,918

(22) Filed: Apr. 21, 2016

(65) Prior Publication Data

US 2016/0312738 A1 Oct. 27, 2016

(30) Foreign Application Priority Data

Apr. 23, 2015 (GB) ..... 1506981.8

(51) Int. Cl.
*F02F 7/00* (2006.01)

(52) U.S. Cl.
CPC .... *F02F 7/0053* (2013.01); *F02F 2007/0041* (2013.01); *F05C 2251/046* (2013.01)

(58) Field of Classification Search
CPC ..... F02F 7/0053; F02F 2007/0041; F05C 2251/046
USPC ..... 123/193.3
See application file for complete search history.

(56) References Cited

U.S. PATENT DOCUMENTS 5,664,538 A * 9/1997 Hutchins ..... F02F 1/108 123/195 R
5,860,404 A * 1/1999 Tanaka ..... F01M 11/02 123/196 R
6,283,081 B1 * 9/2001 Ozeki ..... F02F 1/108 123/193.2
6,886,522 B1 5/2005 Lawrence
7,284,528 B2 10/2007 Natkin et al.
9,086,031 B2 * 7/2015 Williams ..... F02F 7/0021
9,341,136 B2 * 5/2016 Williams ..... F02F 1/18
9,719,461 B2 * 8/2017 Maki ..... F02F 7/0021
2007/0209628 A1 * 9/2007 Natkin ..... F02F 7/0053 123/195 R (Continued)

FOREIGN PATENT DOCUMENTS

DE 202013011394 U1 3/2015
JP 2008082248 A 4/2008

OTHER PUBLICATIONS

Great Britain Patent Office, Great Britain Search Report for Great Britain Application No. GB1506981.8, dated Oct. 15, 2015.

*Primary Examiner* — Joseph Dallo
*Assistant Examiner* — Yi-Kai Wang
(74) *Attorney, Agent, or Firm* — Lorenz & Kopf, LLP

(57) ABSTRACT

An internal combustion engine includes a cylinder block made of a first material having a plurality of cylinders and an insert made of a second material having a greater stiffness and a lower thermal coefficient of expansion than the first material and casted-in-place into the cylinder block. For each cylinder of the cylinder block, the insert includes a bolted anchor having a first threaded bore suitable to be engaged by an head bolt for fixing a cylinder head to the cylinder block, and a second threaded bore suitable to be engaged by a cap bolt for fixing a main bearing cap to the cylinder block, and a lubrication gallery connected to a plurality of the anchors.

17 Claims, 4 Drawing Sheets

(56) References Cited

U.S. PATENT DOCUMENTS

| | | | | |
|---|---|---|---|---|
| 2010/0050977 | A1* | 3/2010 | Park | F02F 7/0085<br>123/195 R |
| 2016/0114386 | A1* | 4/2016 | Kusaka | B22D 17/20<br>164/120 |

* cited by examiner

LIGHTWEIGHT INTERNAL COMBUSTION ENGINE WITH A FERROUS REINFORCED CYLINDER BLOCK

CROSS-REFERENCE TO RELATED APPLICATION

This application claims priority to Great Britain Patent Application No. 1506981.8, filed Apr. 23, 2015, which is incorporated herein by reference in its entirety.

TECHNICAL FIELD

The present disclosure pertains to an internal combustion engine having a cylinder block made of a lightweight material such as aluminum or an aluminum alloy, and further including a reinforcing insert made of a heavier and stiffer material, for example a ferrous material such as cast iron or steel.

BACKGROUND

As known, cylinder blocks cast of aluminum or aluminum alloy have the primary benefit that they are light in weight in comparison with ferrous materials, so offering the opportunity of achieving high power/weight ratios in the internal combustion engine. At the same time such cylinder block are not as strong as similar cylinder block of ferrous materials and are not as well able to withstand the stresses encountered in engine operation.

While the cylinder block made of lightweight metals are useful for internal combustion engine having a low-medium power, wherein the pressure of the gases produced by combustion into the cylinder of the cylinder block usually does not exceed the threshold value of 180-200 bar, they are particularly stressed for high power internal combustion engine, wherein the pressure of the gases produced by combustion exceeds 200 bar.

In particular, two parts of the internal combustion engine which are subject to particularly high stresses are: the connection between the cylinder block and a cylinder head, which cooperates with a piston to define a combustion chamber, and the connection between a lower part of the cylinder block which supports the bearings of a crankshaft and associated caps supporting the lower part of the bearings which are bolted onto the cylinder block at the lower part thereof.

In order to improve the stiffness of the cylinder block, cylinder blocks including lightweight metals and including a reinforcing insert, such as an insert-molded ferrous skeleton, made of a heavier and stiffer metals such as cast iron are known.

The reinforcing skeleton, nevertheless, creates a barrier for the connection between a lubrication gallery, generally defined in the lightweight metal constituting the cylinder block, and the bearings to be lubricated, which result in a complicated and difficult to manufacture layout of the bearings lubrication circuit.

SUMMARY

In accordance with the present disclosure, a cylinder block is provided for an internal combustion engine having a lightweight material reinforced by an insert made of a heavier and stiffer material with an efficient, simple and easy to manufacture layout of the bearings lubrication circuit.

An embodiment of the disclosure provides an internal combustion engine including a cylinder block made of a first material having a plurality of cylinders and an insert made of a second material having a greater stiffness and a lower thermal coefficient of expansion than the first material and casted-in-place into the cylinder block. For each cylinder in the cylinder block, the insert includes a bolted anchor having a first threaded bore suitable to be engaged by an head bolt for fixing a cylinder head to the cylinder block, and a second threaded bore suitable to be engaged by a cap bolt for fixing a main bearing cap to the cylinder block, and a lubrication gallery connected to a plurality of the anchors.

As a result, the lubrication circuit and the reinforcing skeleton both provide the molded insert, made of the heavier and stiffer material, which is a monolithic piece casted-in-place in the cylinder block by means of the same casting. Therefore, the insert provides an efficient, simple and easy to manufacture layout of the bearings lubrication circuit which does not require special machining procedures, but may be directly made by a single casting. Moreover, the bearing lubrication circuit, for example the lubrication gallery, may be stiffer and more resistant against pressure stresses decreasing the internal deformation of the gallery and, thus, allowing benefits in lubricant consumption and in reduction of the emissions of Carbon Dioxide ($CO_2$), without considerable undermining the overall weight of the lightweight cylinder block.

According to an embodiment, the insert may include, for each cylinder, an upper arched beam defining, with the main bearing cap, a ring shaped main bearing support. As a result, the upper arched beam provides a thermal expansion control and holds loads from bearing cap bolts, that pass through each bearing cap and are threaded directly into each corresponding second threaded bore of the insert, thus increasing the stiffness, minimizing weight, and limiting thermal mismatch. In particular, being the main bearing cap usually made of the same stiffer and heavier material of the insert, the upper arched beam and the lower main bearing cap may have the same thermal expansion coefficient, reducing the thermal deformation and mismatch of the ring shaped main bearing support.

According to an embodiment of the present disclosure, the insert may include, for each cylinder, a lubricant passage connecting the lubrication gallery to a main bearing. This aspect of the present disclosure provides a simple and practical solution to design the lubrication circuit layout for the lubrication of the bearings and to manufacture the lubrication circuit, limiting the costs involved in the manufacturing of the lubrication circuit and the cylinder block. Moreover, also the lubrication passages of the bearings lubrication circuit, made by the same monolithic piece constituting the insert casted-in-place in the cylinder block and including the lubrication gallery, may be stiffer and more resistant against pressure stresses, decreasing the internal deformation of the passages and, thus, allowing benefits in lubricant consumption and in reduction of the emissions of Carbon Dioxide ($CO_2$), without considerable undermining the overall weight of the lightweight cylinder block.

According to a further embodiment, the lubricant passage may extend from the lubrication gallery to the upper arched beam. In this way, the lubricant passage layout may be simple and practical, without requiring particular machining efforts and allowing an efficient lubrication of the bearings.

According to an aspect of the present disclosure, the insert may include, for each cylinder, two of the bolted anchors each of which is disposed to a respective end of the upper arched beam. In this way, the clamping load caused by bearing cap bolts and head bolts may be efficiently distributed on the insert which defines the stiff skeleton of the engine block.

According to a still further embodiment, the insert may include a reinforcing lug connecting each anchor to the respective end of the upper arched beam. In this way, for the same reasons explained above, it is allowed a more efficient load distribution on the insert and a more efficient thermal expansion control of the ring shaped main bearing support.

Again, according to a further embodiment, each lubricant passage may pass through one of the reinforcing lugs. This aspect of the present disclosure provides a simple, compact and practical solution to design the lubrication circuit layout and in particular to manufacture the lubricant passages thereof.

According to an aspect of the present disclosure, the first bore and the second bore of an anchor may be axially misaligned. As a result, freedom is provided to design the head bolts and bearing cap bolts arrangement in the cylinder head and the bearing caps respectively, on the basis of the mechanical and load resistance requirements.

For the same reasons formulated above, in alternative or in addition, the first bore and the second bore of an anchor may be axially aligned. According to an aspect of the present disclosure, the anchor may include a plurality of first and/or second bores. In particular, the anchor design may be studied and adjusted for meeting every load and bolts tightening conditions required by the specific internal combustion engine layout.

According to an aspect of the present disclosure, the anchor may have an elongated shape with a longitudinal axis parallel to a longitudinal axis of the cylinder, the first bore and second bore are located, respectively, at an upper free end and a lower free end of the anchor. As a result, the bolts loads may be distributed along the anchors, guaranteeing a greater stiffness and an efficient load resistance and balancing.

According to an aspect of the present disclosure, the first material may include or be aluminum and/or the second material may include or be a ferrous metal. As a result, the internal combustion engine design may have a high load resistance allowing, at the same time, a weight minimization.

A still further embodiment of the present disclosure provides an automotive system, in particular a passenger car, including an internal combustion engine as described above.

BRIEF DESCRIPTION OF THE DRAWINGS

The present disclosure will hereinafter be described in conjunction with the following drawing figures, wherein like numerals denote like elements.

DETAILED DESCRIPTION

The following detailed description is merely exemplary in nature and is not intended to limit the invention or the application and uses of the invention. Furthermore, there is no intention to be bound by any theory presented in the preceding background of the invention or the following detailed description.

Figure 1:
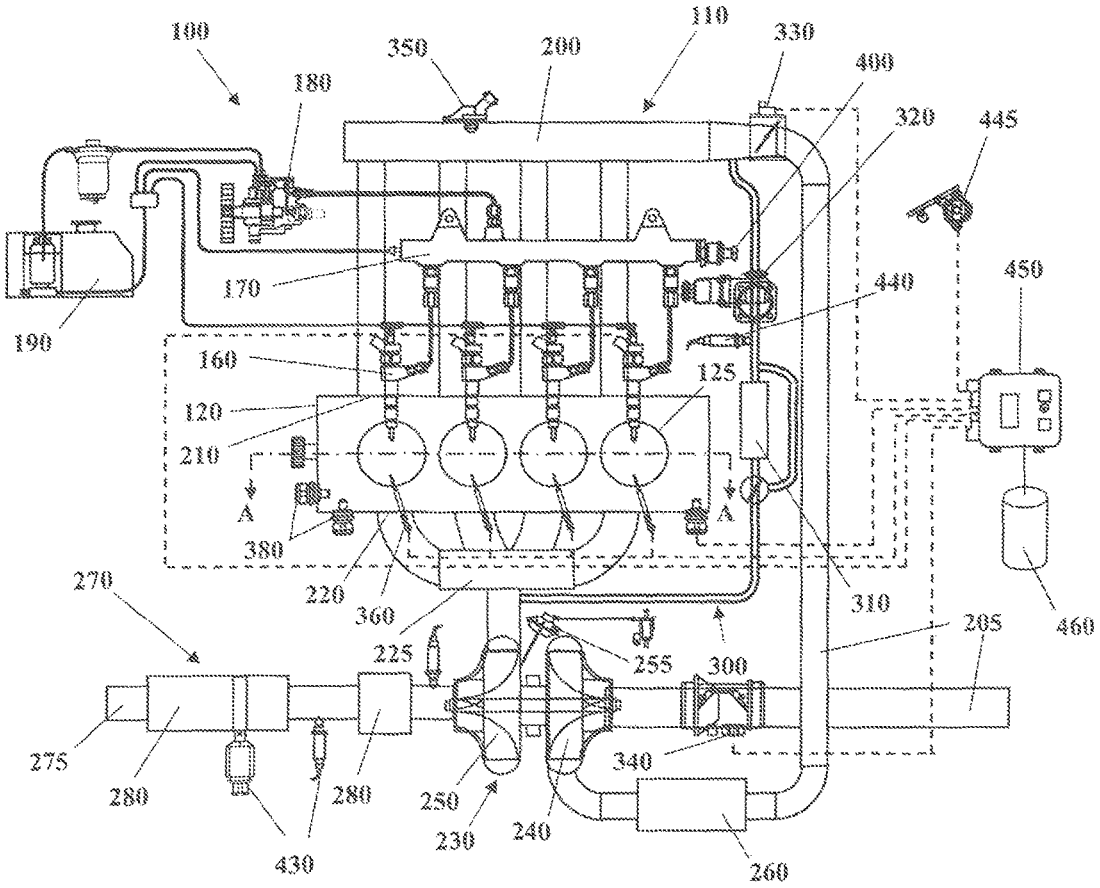
FIG. 1 shows an automotive system.
Figure 2:
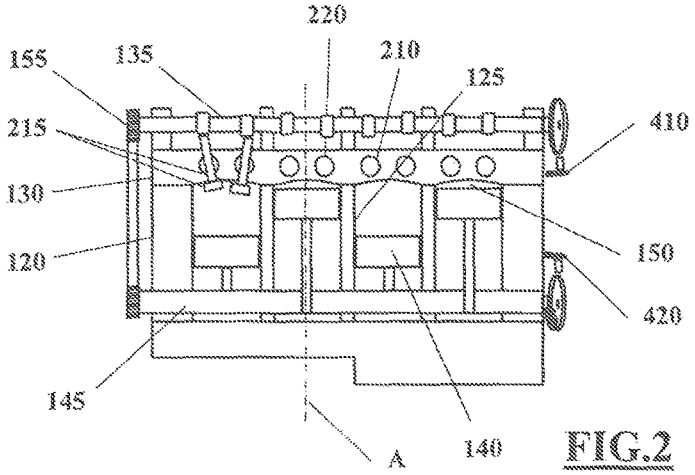
FIG. 2 is a cross-section of an internal combustion engine belonging to the automotive system of FIG. 1.
Figure 3:
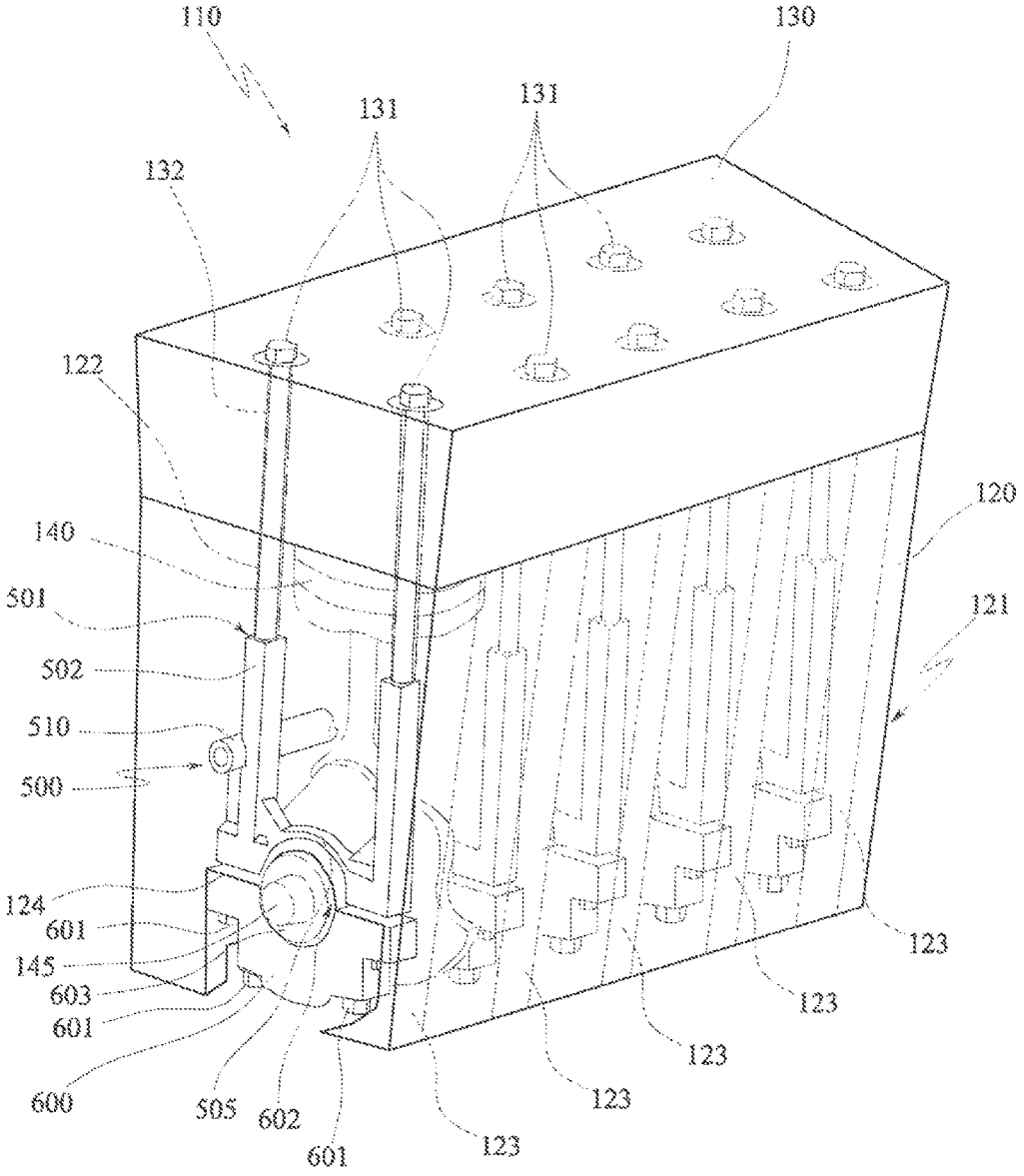
FIG. 3 is a schematic axonometric view of the internal combustion engine.
Figure 4:
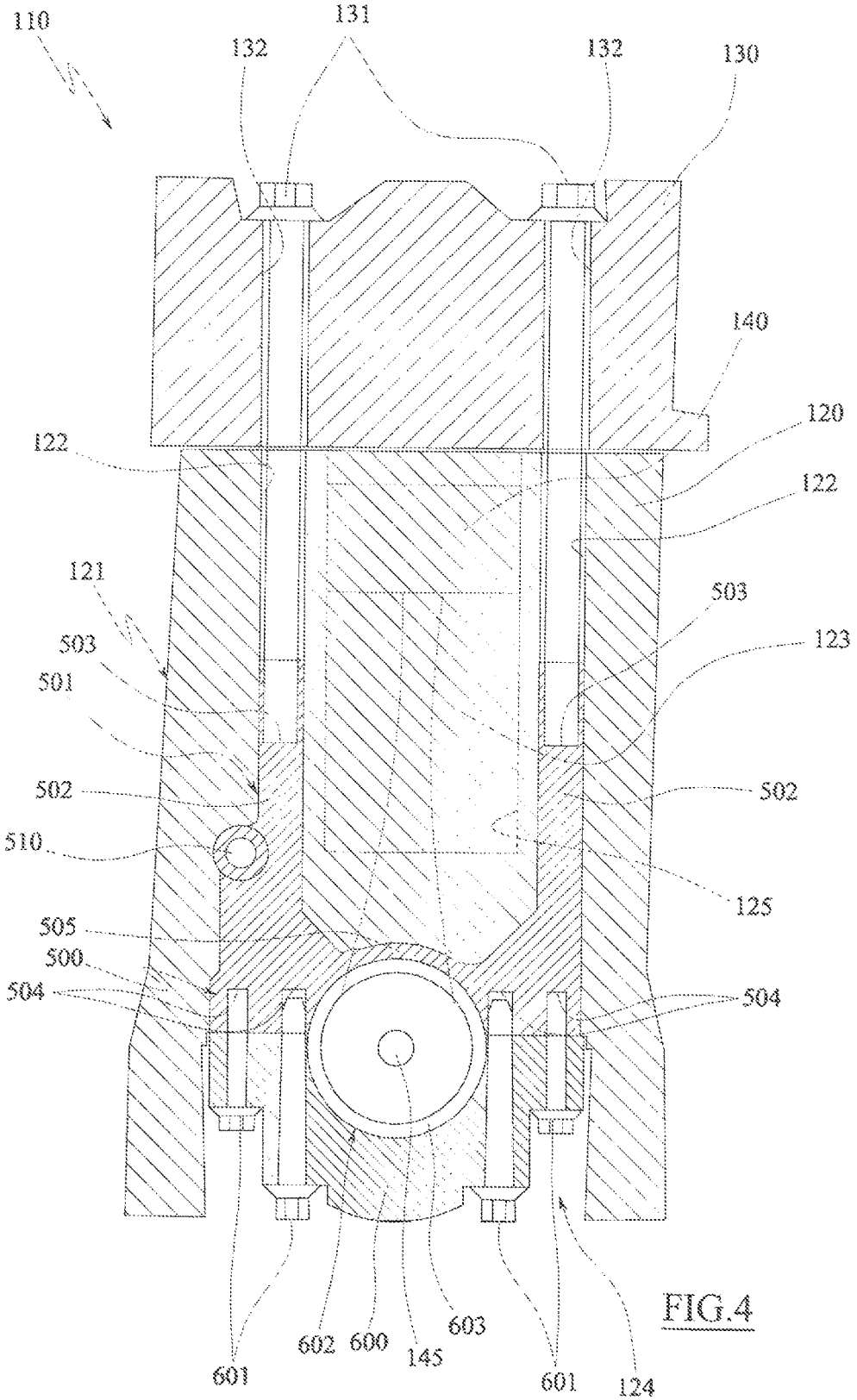
FIG. 4 is a cross-sectional view of the internal combustion engine of FIG. 3.
Figure 5:
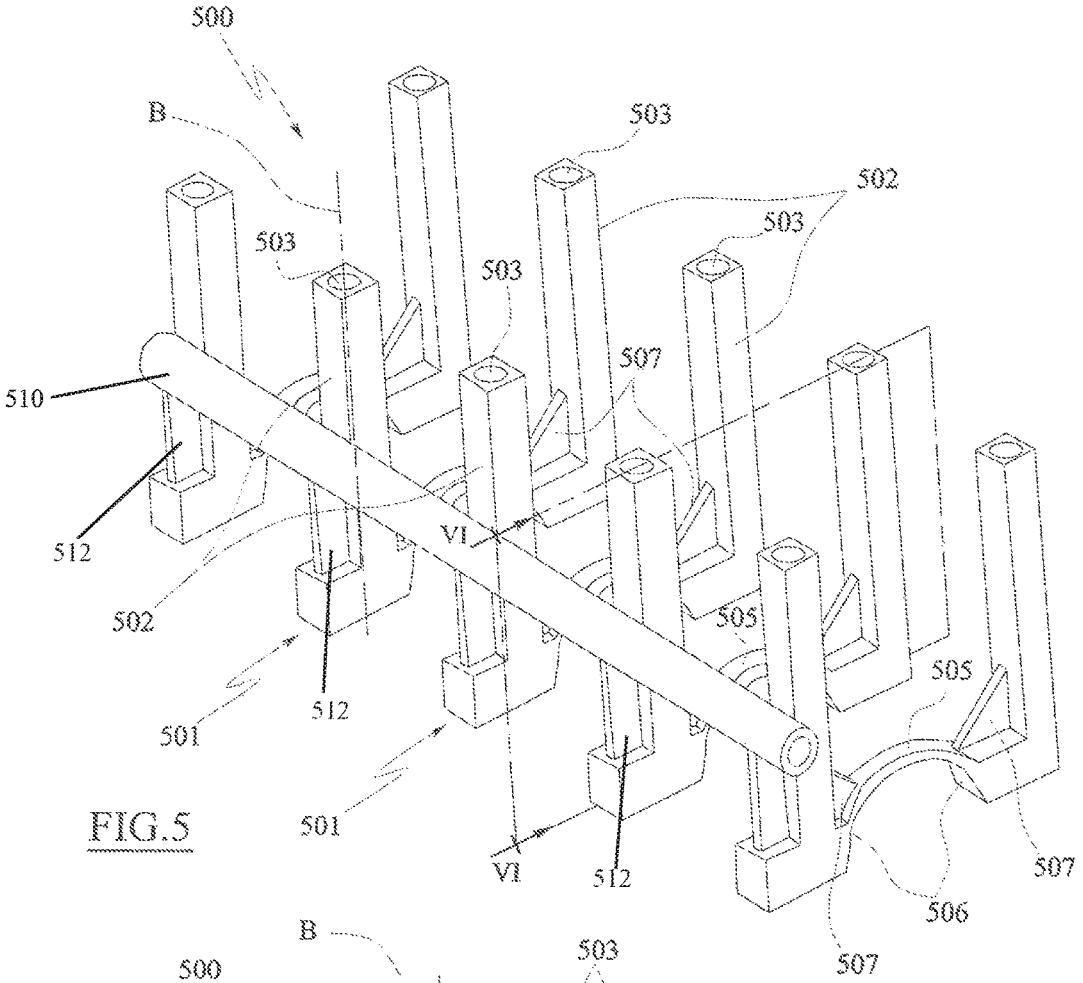
FIG. 5 is a schematic axonometric view of the insert casted-in-place into the cylinder block of the internal combustion engine of FIG. 3.
Figure 6:
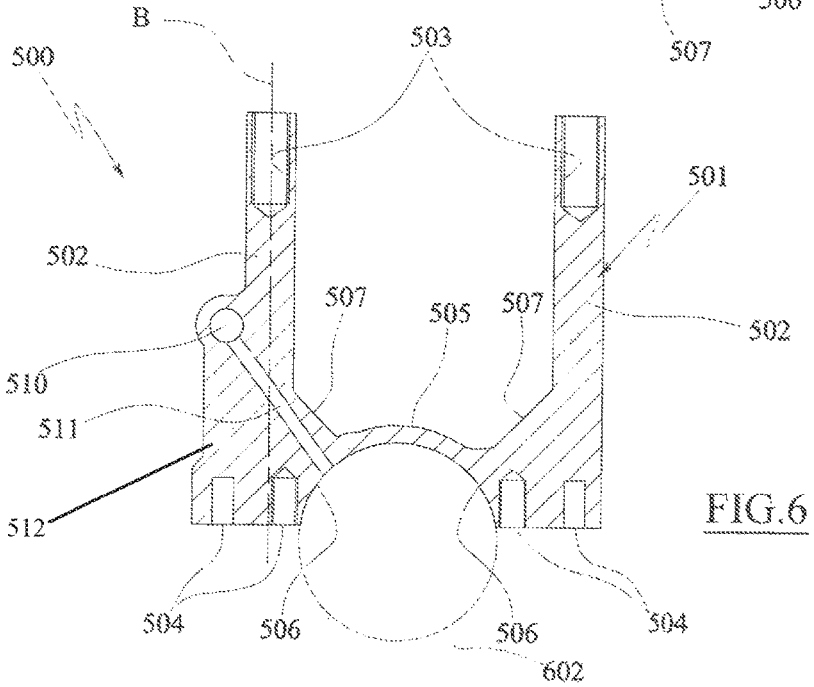
FIG. 6 is a cross-sectional view of the insert taken along plane VI-VI of FIG. 4.

Some embodiments may include an automotive system 100, as shown in FIGS. 1 and 2, that includes an internal combustion engine (ICE) 110 having a cylinder block 120 defining at least one cylinder 125 having a piston 140 coupled to rotate a crankshaft 145. A cylinder head 130 cooperates with the piston 140 to define a combustion chamber 150.

A fuel and air mixture (not shown) is disposed in the combustion chamber 150 and ignited, resulting in hot expanding exhaust gasses causing reciprocal movement of the piston 140. The fuel is provided by at least one fuel injector 160 and the air through at least one intake port 210. The fuel is provided at high pressure to the fuel injector 160 from a fuel rail 170 in fluid communication with a high pressure fuel pump 180 that increase the pressure of the fuel received from a fuel source 190.

Each of the cylinders 125 has at least two valves 215, actuated by a camshaft 135 rotating in time with the crankshaft 145. The valves 215 selectively allow air into the combustion chamber 150 from the port 210 and alternately allow exhaust gases to exit through a port 220. In some examples, a cam phaser 155 may selectively vary the timing between the camshaft 135 and the crankshaft 145.

The air may be distributed to the air intake port(s) 210 through an intake manifold 200. An air intake duct 205 may provide air from the ambient environment to the intake manifold 200. In other embodiments, a throttle valve 330 may be provided to regulate the flow of air into the intake manifold 200. In still other embodiments, a forced air system such as a turbocharger 230, having a compressor 240 rotationally coupled to a turbine 250, may be provided. Rotation of the compressor 240 increases the pressure and temperature of the air in the duct 205 and intake manifold 200. An intercooler 260 disposed in the duct 205 may reduce the temperature of the air.

The turbine 250 rotates by receiving exhaust gases from an exhaust manifold 225 that directs exhaust gases from the exhaust ports 220 and through a series of vanes prior to expansion through the turbine 250. The exhaust gases exit the turbine 250 and are directed into an exhaust gas aftertreatment system 270. This example shows a variable geometry turbine (VGT) 250 with a VGT actuator 255 arranged to move the vanes to alter the flow of the exhaust gases through the turbine 250.

The exhaust gas aftertreatment system 270 may include an exhaust gas line 275 having one or more exhaust aftertreatment devices 280. The aftertreatment devices 280 may be any device configured to change the composition of the exhaust gases. Some examples of aftertreatment devices 280 include, but are not limited to, catalytic converters (two and three way), oxidation catalysts, lean NOx traps, hydrocarbon adsorbers, selective catalytic reduction (SCR) systems, and particulate filters. Other embodiments may include an exhaust gas recirculation (EGR) duct 300 coupled between the exhaust manifold 225 and the intake manifold 200. The EGR duct 300 may include an EGR cooler 310 to reduce the temperature of the exhaust gases in the EGR duct 300. An EGR valve 320 regulates a flow of exhaust gases in the EGR duct 300.

The automotive system 100 may further include an electronic control unit (ECU) 450 in communication with one or more sensors and/or devices associated with the ICE 110. The ECU 450 may receive input signals from various sensors configured to generate the signals in proportion to various physical parameters associated with the ICE 110. The sensors include, but are not limited to, a mass airflow, pressure, temperature sensor 340, a manifold pressure and temperature sensor 350, a combustion pressure sensor 360, coolant and oil temperature and level sensors 380, a fuel rail pressure sensor 400, a cam position sensor 410, a crank position sensor 420, exhaust pressure and temperature sensors 430, an EGR temperature sensor 440, and an accelerator pedal position sensor 445.

Furthermore, the ECU 450, which may include a digital central processing unit (CPU 460) in communication with a memory system and an interface bus, may generate output signals to various control devices that are arranged to control the operation of the ICE 110, including, but not limited to, the fuel injector 160, the throttle valve 330, the EGR Valve 320, the VGT actuator 290, the waste gate actuator 252 and the cam phaser 155. Note, dashed lines are used to indicate communication between the ECU 450 and the various sensors and devices, but some are omitted for clarity.

As shown in FIGS. 3-6, the cylinder block 120 includes a plurality of cylinders 125, for example four cylinders as illustrated, preferably arranged in a direction parallel to the crankshaft 145. The cylinder block 120 includes a first metal material such as aluminum or an aluminum matrix composite alloy and an insert 500 that is insert-molded into a crankshaft-cylinder region 121 of the cylinder block 120. The insert 500 includes a second metal material such as cast iron or steel or a metal alloy that has greater stiffness and a lower thermal coefficient of expansion than the first metal.

The cylinder block 120 includes, as usual, a plurality of engine cylinder sections each of which is formed therein with a cylinder 125, opening through a top surface of the cylinder block 120 to which the cylinder head 130 is fastened.

The cylinder head 130 is secured to the cylinder block 120 by means of a plurality of head bolts 131, in particular at least four head bolts 131 per cylinder, each of which is mounted in a mounting through bore 132 disposed in the cylinder head 130 and vertically aligned with a respective mounting bore 122 disposed in the cylinder block 120.

A plurality of main bearing bulkheads 123, in the example in number of five, are connected integrally to the cylinder sections, and disposed vertically relative to the cylinder block 120 and parallel with each other. The main bearing bulkheads 123 serve as partition walls which separate the cylinder block 120 into a plurality of chambers for respective cylinder sections including respective cylinders 125. A lower section of each main bearing bulkhead 123 includes a bearing saddle area 124 for supporting the crankshaft 145.

The insert 500 is formed as a monolithic piece and cast-in-place near the bearing saddle area 124 of the cylinder block 120, where the lightweight cylinder block material, such as aluminum, is cast around the reinforcing insert 500. The insert 500 includes a plurality of portal frames 501, for example at least one for each cylinder 125 preferably two per cylinder, and more particularly each of the portal frames 501 is cast-in-place into each of the main bearing bulkheads 123 of the cylinder block 120.

Each of the portal frames 501, particularly, includes at least one elongated anchor 502 arranged with its longitudinal axis B parallel to the longitudinal axis A of the cylinders 125. Each of the anchors 502, in the example, vertically extends from the bearing saddle area 124 to a lower end of one of the mounting bore 122 of the cylinder block 120. Each of the portal frames 501 includes two of the identical anchors 502 parallel and spaced-apart with each other. Each of the anchors 502 includes, at the top, a first threaded bore 503 suitable to be engaged by one of the head bolt 131 for fixing the cylinder head 130 to the cylinder block 120. In particular, each of the first threaded bores 503 axially extends downwardly a respective mounting bore 122 of the cylinder block 120.

Each of the anchors 502 includes, at the bottom, one or more second threaded bores 504, for example parallel to the first threaded bore 503. In the example shown in figures, the second threaded bores 504 are misaligned with the first threaded bore 503 and, for example, there are two second threaded bores 504 for each anchor 502 located at different distances from the crankshaft 145. Each of the second threaded bores 504 is suitable to be engaged by a cap bolt 601 for fixing a main bearing cap 600 to the cylinder block 120.

As shown in figures, the ICE 110 includes a plurality of main bearing caps 600, in particular in number equal of the main bearing bulkheads 123, each of which is bolted, by means of one or more of the cap bolts 601 to one of the anchors 502 of the insert 500. Each of the portal frames 501 further includes an upper arched beam 505 coaxially casted-in-place into the bearing saddle area 124 of the main bearing bulkhead 123. Each of the anchors 502, in particular the lower part of it, is rigidly fixed to an end 506 of the upper arched beam 505.

Each of the main bearing caps 600 defines, with the upper arched beam 505 of each portal frame 501 of the inserts 500, respective crankshaft support rings 602. All the aligned crankshaft support rings 602 define a crankshaft bore coaxially aligned with the rotational axis of the crankshaft 145. Each of the crankshaft support rings 602 is configured to retain main bearings 603 for rotatably supporting the crankshaft 145 along the crankshaft bore. Each of the main bearing caps 600 includes a metal material such as cast iron or steel or a metal alloy having higher stiffness and a lower thermal coefficient of expansion than the first metal constituting the engine block 120 and are supported on the respective portal frame 501 of the insert 500 independently of any direct connection to the cylinder block 120 to reduce thermal mismatch stresses and crankshaft bore distortion.

The monolithic insert 500 further includes a lubrication gallery 510 connecting each of the portal frames 501, in particular each of the anchors 502 arranged at the same side of the cylinders 125 and aligned along a direction parallel to the crankshaft 145. Preferably, the lubrication gallery 510 branches from a central zone of the anchors 502 interposed between the top and the bottom thereof externally with respect to the cylinder 125. In the example shown in figures, the lower part of the anchor 502 includes a supporting bracket 512 branching from the anchor 502 and on which the lubrication gallery 510 rests.

The lubrication gallery 510 has a tubular shape, for example rectilinear, and is arranged parallel to the crankshaft 145. Preferably the lubrication gallery 510 is open at the opposite ends and has an internal cavity with circular cross sections. The lubrication gallery 510 moreover is casted-in-place into a cylinder area, superimposed to the bearing saddle area 124, of the crankshaft-cylinder region 121 of the cylinder block 120. The lubrication gallery 510 is in fluid communication with an engine lubricant recirculating pump (not shown) which delivers lubricant from an engine lubricant sump (not shown) to each of the main bearings 603, as better explain as follow.

Each of the portal frames 501 has at least one lubricant passage 511 extending from the lubrication gallery 510 to the upper arched beam 505. In particular, each of the lubricant passages 511 has an inlet which opens into the internal cavity of the lubrication gallery 510 and an outlet communicating with an area of the external periphery of the main bearing 603 supported by the portal frame 501. For example, each of the lubricant passages 511 is substantially rectilinear and extends substantially in a radial direction with respect to the crankshaft 145. Each of the anchors 502 of a portal frame 501 has a reinforcing lug 507, having a substantially triangular shape, which connects the anchor 502 to the respective end 506 of the upper arched beam 505.

The lubricant passage 511 of each of the portal frames 501 passes through the reinforcing lug 507 which connects the upper arched beam 505 to the anchor 502 which is fixed to the lubrication gallery 510. The reinforcing lugs 507 of a portal frame 501 may be dimensioned in such a way that the mass of the lug 507 including the lubricant passage 511 is substantially equal to the mass of the other lug 507 of the same portal frame 501.

As shown in figures, the cast iron insert 500 may be positioned within the bearing saddle area 124 and the cylinder area of the cylinder block 120, in particular, the insert 500 may be placed into a mold for casting the cylinder block 120 and molten aluminum is poured around the insert 500, in such a way to provide the cylinder block 120 once cured.

While at least one exemplary embodiment has been presented in the foregoing detailed description, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing an exemplary embodiment, it being understood that various changes may be made in the function and arrangement of elements described in an exemplary embodiment without departing from the scope of the invention as set forth in the appended claims and their legal equivalents.

What is claimed is:

1. An engine block for an internal combustion engine comprising:

a cylinder block having a plurality of cylinders formed therein and made of a first material having a first stiffness and a first thermal coefficient of expansion; and a monolithic insert made of a second material having a second stiffness which is greater than the first stiffness and a second thermal coefficient of expansion which is less than first thermal coefficient of expansion, the insert casted-in-place into the cylinder block, the insert including, for each of the plurality of cylinders, a first anchor having a first threaded bore configured to engage an head bolt for fixing a cylinder head to the cylinder block, and a second threaded bore configured to engage a cap bolt for fixing a main bearing cap to the cylinder block, the first anchor having a first sidewall opposite a second sidewall, a second anchor spaced apart from the first anchor, an upper arched beam that interconnects the first anchor and the second anchor, the upper arched beam having a top surface opposite a bottom surface, the bottom surface configured to receive a crankshaft support ring, a reinforcing lug that interconnects the second sidewall of first anchor and the top surface of the upper arched beam, with the reinforcing lug having an end proximate an arch of the upper arched beam, with a portion of a lubrication passage defined through the reinforcing lug, a supporting bracket that branches from the first sidewall of the first anchor, and the insert includes a lubrication gallery connected to each of the support brackets that extends along the insert in a direction parallel to a crankshaft of the internal combustion engine, the lubrication gallery in communication with the lubrication passage of each of the reinforcing lugs.

2. The engine block according to claim 1, wherein the upper arched beam defines a main bearing support.

3. The engine block according to claim 2, wherein the lubricant passage provides fluid communication between the lubrication gallery and the main bearing support.

4. The engine block according to claim 3, wherein the lubricant passage extends from the lubrication gallery to the upper arched beam.

5. The engine block according to claim 2, wherein the first and second anchors are disposed at respective ends of the upper arched beam.

6. The engine block according to claim 1, wherein the first threaded bore and the second threaded bore of the anchor are axially misaligned.

7. The engine block according to claim 1, wherein the first threaded bore and the second threaded bore of the anchor are axially aligned.

8. The engine block according to claim 1, wherein each of the anchors comprise a plurality of first threaded bores.

9. The engine block according to claim 8, wherein each of the anchors comprise a plurality of second threaded bores.

10. The engine block according to claim 1, wherein each of the anchors has an elongated shape with a longitudinal axis parallel to a longitudinal axis of the cylinder, the first threaded bore and second threaded bore being located, respectively, at an upper free end and a lower free end of each of the anchors.

11. The engine block according to claim 1, wherein the first material comprises aluminum.

12. The engine block according to claim 11, wherein the second material comprises a ferrous metal.

13. The engine block according to claim 1, wherein the second material comprises a ferrous metal.

14. An internal combustion engine comprising:

a crankshaft;

a cylinder block having a plurality of cylinders formed therein and made of a first material having a first stiffness and a first thermal coefficient of expansion;

a monolithic insert made of a second material having a second stiffness which is greater than the first stiffness and a second thermal coefficient of expansion which is less than first thermal coefficient of expansion, the insert casted-in-place into the cylinder block and the insert includes, for each of the plurality of cylinders, a first anchor having a first threaded bore, a second threaded bore, a first sidewall opposite a second sidewall, a supporting bracket that branches from the first sidewall of the first anchor, a second anchor spaced apart from the first anchor and extending parallel to the first anchor, an upper arched beam that interconnects the first anchor with the second anchor, the upper arched beam having a top surface opposite a bottom surface, the bottom surface configured to receive a crankshaft support ring, a first reinforcing lug that interconnects the second sidewall of the first anchor and the top surface of the upper arched beam, and a second reinforcing lug that interconnects the second anchor and the top surface of the upper arched beam, the second reinforcing lug spaced apart from the first reinforcing lug by an arch of the upper arched beam, with a portion of a lubrication passage defined through the first reinforcing lug;

a cylinder head fixed to the cylinder block by a head bolt that engages the first threaded bores; and a plurality of main bearing caps fixed to a respective one of the anchors of the insert by a cap bolt that engages the second threaded bore, wherein the insert includes a lubrication gallery connected to each of the anchors that extends along the insert in a direction parallel to the crankshaft, and the lubrication gallery is connected to each of the supporting brackets and in communication with the lubrication passage of each of the first reinforcing lugs.

15. The internal combustion engine according to claim 14, wherein, for each of the plurality of cylinders, the upper arched beam defines a ring shaped main bearing support with the main bearing cap.

16. The internal combustion engine according to claim 15, wherein, for each of the plurality of cylinders, the lubricant passage provides fluid communication between the lubrication gallery and the main bearing support.

17. The internal combustion engine according to claim 14, wherein each of the anchors has an elongated shape with a longitudinal axis parallel to a longitudinal axis of the cylinder, the first threaded bore and second threaded bore being located, respectively, at an upper free end and a lower free end of each of the anchors.

* * * * *